US005451101A

United States Patent [19]

Ellison et al.

[11] Patent Number: 5,451,101

[45] Date of Patent: Sep. 19, 1995

[54] WIRE MANAGEMENT SYSTEM

[75] Inventors: Samuel J. Ellison, Grand Rapids; John VanKammen, Belmont; Daniel Grabowski, Grand Rapids, all of Mich.; Bruce Finlayson, Madison, Wis.

[73] Assignee: Steelcase Inc., Grand Rapids, Mich.

[21] Appl. No.: 137,953

[22] Filed: Oct. 15, 1993

[51] Int. Cl.[6] ..... A47B 13/00

[52] U.S. Cl. ..... 312/223.6; 248/74.2

[58] Field of Search ..... 312/223.6; 248/72.2, 248/72.4, 74.2, 74.1

[56] References Cited

U.S. PATENT DOCUMENTS

| | | | |
|---|---|---|---|
| 323,271 | 7/1885 | Brower . | |
| 1,073,574 | 9/1913 | Wilson . | |
| 1,786,823 | 12/1930 | Carrington et al. . | |
| 2,014,329 | 9/1935 | Hellmann . | |
| 2,141,954 | 12/1938 | Jones . | |
| 2,306,209 | 12/1942 | Elofson et al. . | |
| 2,497,278 | 2/1950 | Soderlund . | |
| 2,853,351 | 9/1958 | Bassett . | |
| 2,928,703 | 3/1960 | Paulsen . | |
| 3,000,682 | 9/1961 | Loew et al. . | |
| 3,043,643 | 7/1962 | Wilmer . | |
| 3,058,794 | 10/1962 | Barber . | |
| 3,089,211 | 5/1963 | Perusse | 24/555 X |
| 3,125,387 | 3/1964 | Abrahamson . | |
| 3,157,446 | 11/1964 | Stark . | |
| 3,193,229 | 6/1965 | Stock | 248/74.2 |
| 3,471,947 | 10/1969 | Genser . | |
| 3,635,174 | 1/1972 | Ball et al. | 312/223.6 X |
| 3,770,334 | 11/1973 | Weber . | |
| 3,783,175 | 1/1974 | Timmons . | |
| 3,787,605 | 1/1974 | Van Gessel et al. . | |
| 3,883,202 | 5/1975 | Konig . | |
| 3,922,045 | 11/1975 | Meyer . | |
| 4,040,692 | 8/1977 | Sass et al. | 312/194 |
| 4,094,256 | 6/1978 | Holper et al. | 312/223.6 X |
| 4,094,561 | 6/1978 | Wolff et al. | 312/223.6 |
| 4,163,867 | 8/1979 | Breidenbach . | |
| 4,257,203 | 3/1981 | Propst et al. . | |
| 4,296,981 | 10/1981 | Hildebrandt et al. | 312/223.6 X |
| 4,323,291 | 4/1982 | Ball | 312/194 |
| 4,372,629 | 2/1983 | Propst et al. . | |
| 4,406,101 | 9/1983 | Heidmann . | |
| 4,433,630 | 2/1984 | Laborie . | |
| 4,535,703 | 8/1985 | Henriott et al. | 312/223.6 X |
| 4,551,577 | 11/1985 | Byrne . | |
| 4,619,486 | 10/1986 | Hannah et al. . | |

(List continued on next page.)

FOREIGN PATENT DOCUMENTS

| | | | |
|---|---|---|---|
| 511822A1 | 11/1992 | European Pat. Off. . | |
| 2555423 | 9/1984 | France . | |
| 2525498 | 12/1976 | Germany . | |
| 2245162 | 1/1992 | United Kingdom | 312/223.6 |

OTHER PUBLICATIONS

Lucas Furniture Systems "Programme 2" brochure., 1981.

*Primary Examiner*—James R. Brittain
*Assistant Examiner*—Robert J. Sandy
*Attorney, Agent, or Firm*—Price, Heneveld, Cooper, Dewitt & Litton

[57] ABSTRACT

A desk, credenza, return and the like article of furniture includes a horizontal worksurface or top and vertical support panels. Access openings are provided in the vertical panels and in the top. A plurality of wire management supports are cantilevered from or positioned adjacent vertical panels of the article to support wires, cables, conduit and the like within the interior of the article. Openable or removable covers are provided to close the access openings in the furniture. Rear panels of the article may be removable to provide access to the interior of pedestals and the like for routing wire through the interior of the furniture.

69 Claims, 6 Drawing Sheets

U.S. PATENT DOCUMENTS 4,637,666 1/1987 Worrell et al. .
4,654,756 3/1987 Wilson et al. .
4,656,798 4/1987 Hazen ..... 174/48 X
4,681,378 7/1987 Hellman, III .
4,688,491 8/1987 Herrera et al. ..... 108/50
4,734,826 3/1988 Wilson et al. .
4,747,788 5/1988 Byrne .
4,762,072 8/1988 Boundy et al. .
4,792,881 12/1988 Wilson et al. .
4,827,850 5/1989 Diffrient .
4,828,513 5/1989 Morrison et al. .
4,869,564 9/1989 Lechman .
4,879,955 11/1989 Moll et al. .
4,883,330 11/1989 Armstrong et al. .
4,884,513 12/1989 Newhouse et al. .
4,948,205 8/1990 Kelley .
4,950,839 8/1990 Quinn et al. .
5,024,167 6/1991 Hayward .
5,050,267 9/1991 Quest .
5,130,494 7/1992 Simonton et al. ..... 312/223.1 X
5,144,896 9/1992 Fortsch ..... 312/223.6 X
5,160,188 11/1992 Rorke et al. .
5,167,047 12/1992 Plumley ..... 174/48 X
5,237,935 8/1993 Newhouse et al. ..... 312/223.6 X

WIRE MANAGEMENT SYSTEM

BACKGROUND OF THE INVENTION

The present invention relates principally to furniture, such as desks, tables, credenzas, returns, cabinets and tile like, and, more particularly, to a wire management system for such articles of furniture.

Heretofore, various proposals have been made for managing the numerous wires, cables, cords and the like associated with a wide variety of equipment found in the modern office. Freestanding lights, calculators, printers, computers, telephone lines and other communications data wires may all be found at a single desk or work station. Unless provision is made to route tile wires and the like interiorly of the desk structure, a cluttered and inefficient work environment will result which also detracts significantly from the aesthetics of the furniture.

Various wire management systems which have been proposed include access openings in the vertical panels of the furniture and in the tops. Provision has been made for closing the access openings when not needed for wire management purposes. Prior approaches have included elongated wiring channels or troughs which run the full length or width of the desk, credenza or the like and within which the various wires and cables are routed. In addition, office furniture has been provided with removable panels to provide access to the interior and to the wiring channels and ducts. Examples of prior proposals may be found in U.S. Pat. No. 1,786,823 entitled DESK, which issued on Dec. 30, 1930 to Carrington et al; U.S. Pat. No. 3,883,202 entitled DESK HAVING ELECTRICAL SUPPLY LINES WHICH ARE LAID IN THE TABLE, which issued on May 13, 1975 to Konig; U.S. Pat. No. 3,922,045 entitled MODULAR STRUCTURE, which issued on Nov. 25, 1975 to Meyer; and U.S. Pat. No. 4,163,867 entitled WIRING ACCESS SYSTEM FOR DESKS AND THE LIKE, which issued on Aug. 7, 1979 to Breidenbach. efficiency while remaining aesthetically pleasing, with reduced cost and complexity from that heretofore found.

SUMMARY OF THE INVENTION

In accordance with the present invention, the aforementioned needs are fulfilled. Essentially, an article of furniture, such as a desk, credenza and the like, is provided with all access opening in a top or vertical panel. A plurality of wire management supports, hooks or clips are attached to vertical panels of the article of furniture in a cantilevered fashion. Provision is made for closing the access openings when not in use.

In narrower aspects of the invention, the article of furniture may be provided with a removable vertical panel and a security panel which prevents access to file drawers and the like. The wire management supports include a base, front and rear walls joined to the base and a hook-like portion configured to snap over and clamp onto the security panel or other vertical panel of the furniture.

Access openings in the top of the article of furniture may be closed by a closure subassembly including a sleeve configured to be received within the access opening and which removably supports at least one access the. The access the may define a slot through which wires and the like may pass. Different tiles may be arranged and rearranged along the access opening to suit the needs of the particular user.

The wire management system in accordance with the present invention is readily adapted to existing articles of furniture and readily incorporated into desks, credenzas, returns and the like. The system provides for efficient and aesthetically pleasing management of the large number of wires, cables, power cords and related equipment typically found in the office environment. The system is easily manufactured, possesses reduced complexity from prior systems and may be included at reduced costs from that heretofore experienced.

DETAILED DESCRIPTION OF THE PREFERRED EMBODIMENT

Figure 1:
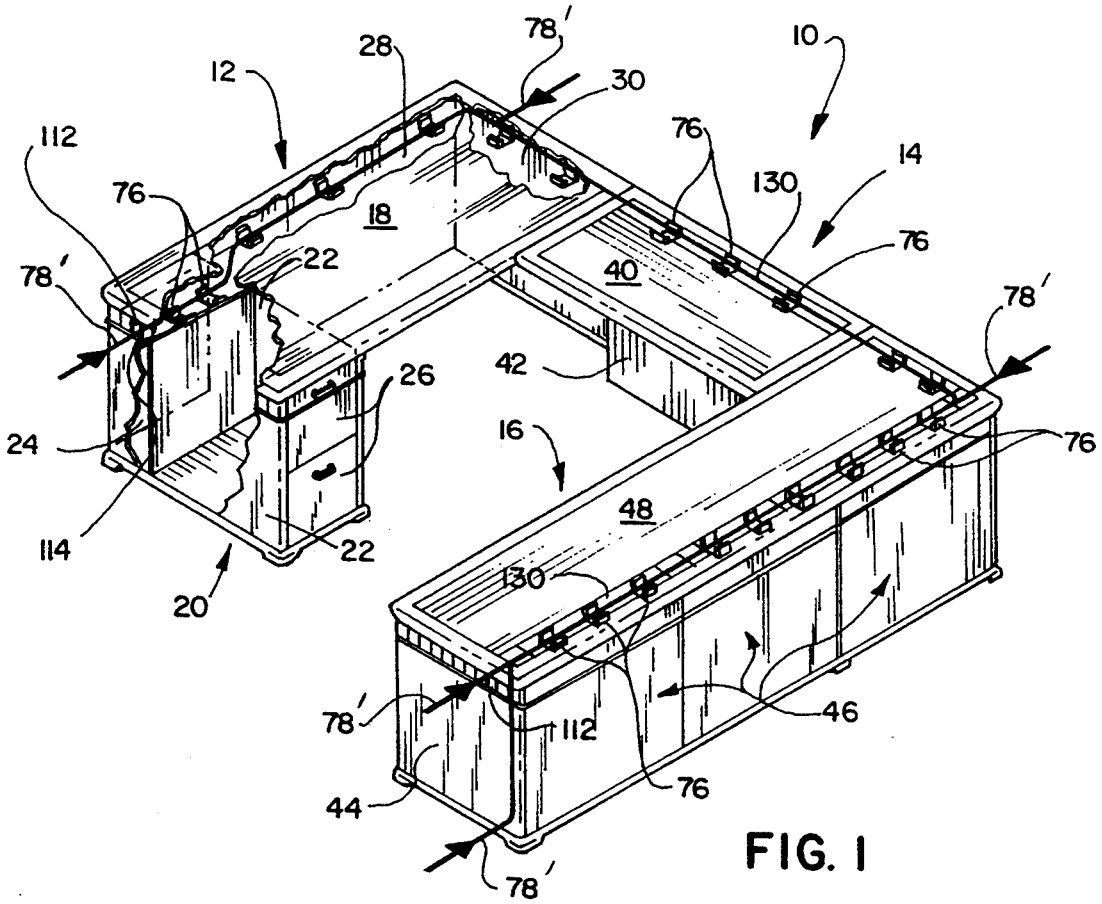
FIG. 1 is a perspective view of a work station incorporating the wire management system in accordance with the present invention.

A work station incorporating a wire management system in accordance with the present invention is illustrated in FIG. 1 and generally designated by the numeral 10. Work station 10 includes a plurality of articles of furniture, namely, a desk 12, a return or transition section 14 and a credenza 16. Desk 12 includes a top or horizontal worksurface 18 and a pedestal 20. Pedestal 20 includes side panels 22 and a rear panel 24. Drawers 26 are slideably mounted within the pedestal in a conventional fashion. Desk 12 further includes a modesty panel 28 and an end panel 30. Return 14 extends from end panel 30 and top 18 and interconnects desk 12 with credenza 16. Return 14 includes a top or horizontal worksurface 40 and a modesty panel 42. Credenza 16 includes end panels 44 and rear panels 46. The panels support a top or horizontal worksurface 48. Modesty panels 28, 42 and other vertical panels 24, 46 may be removably mounted on the furniture articles. The modesty panels may be hinged to adjacent panels or pedestals so that they may be pivoted inwardly into the knee space or well defined by the article of furniture or outwardly therefrom. An example of a desk with a hinged modesty panel may be found in U.S. Pat. No. 2,853,251 entitled DESK WITH APRON, which issued on Sep. 23, 1958 to Bassett. The hinge mounting permits the modesty panel to pivot in both directions.

Figure 2:
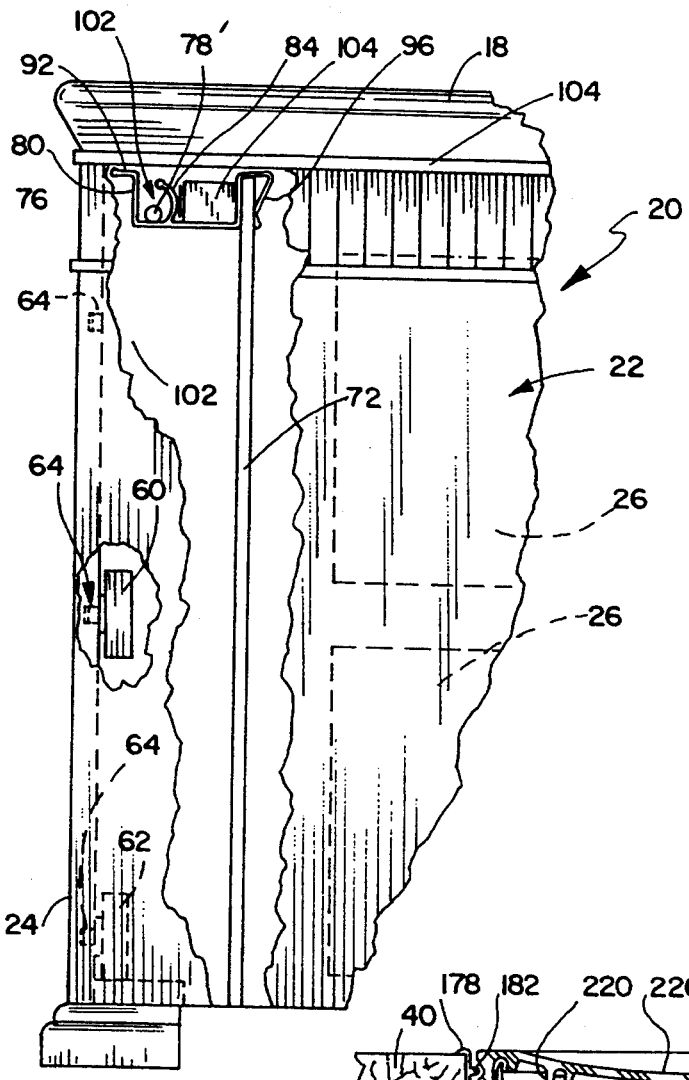
FIG. 2 is a fragmentary, side, elevational view of a portion of the work station illustrated in FIG. 1.

As seen in FIG. 2, pedestal 20 includes stretchers or structural members 60, 62 which extend between side panels 22. Rear panel 24 is removably and detachably mounted on pedestal 20 at stretchers 60, 62 by snap fasteners 64. Fasteners 64 include pins or studs which snap into apertures positioned in the panel or stretcher. Panel 24 may, therefore, be removed to provide access to the interior of pedestal 20. Panels 46 of credenza 16 may also be removably mounted in a similar fashion.

Since panel 24 is removable, protection must be provided for the file drawers 26 mounted within the pedestal. In accordance with the present invention, a security panel 72 is secured to and extends between side panels 22 of the pedestal. The side panels may be routed to form grooves or channels within which security panel 72 is retained. Panel 72 extends upwardly for enough to prevent access to drawers 26 when panel 24 is removed.

In accordance with the present invention, a plurality of wire management supports, clips or hooks generally designated 76 are provided. Supports 76 may be suspended in spaced relationship and in a cantilevered fashion from the vertical panels of the articles of furniture. As schematically illustrated in FIG. 1, the hooks or clips 76 support wires, cables and the like 78 which are directed through access openings in the furniture.

Figure 4:
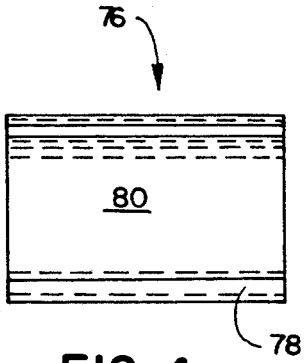
FIG. 4 is a front, elevational view thereof.
Figure 3:
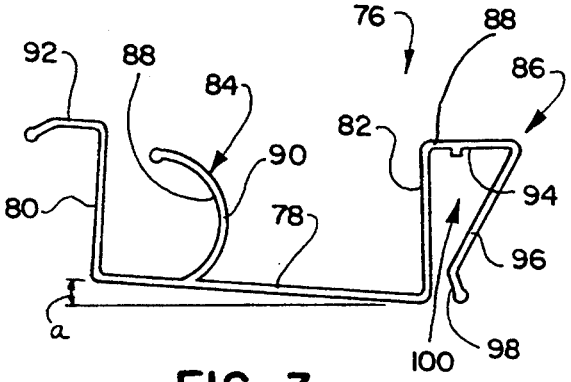
FIG. 3 is a side, elevational view of a wire management support included in the present invention.

As seen in FIGS. 3 and 4, each wire management support 76 includes a base 78, a front wall 80, a rear wall 82 and an intermediate partition 84. An attachment clip or hook portion 86 extends rearwardly from an upper edge 87 of wall 82. Base 78 is joined to and extends at an angle "a" upwardly from horizontal front wall 82. In an existing embodiment, angle "a" is approximately four degrees. Partition 84 is smoothly curved in cross section or side elevation and has a semicircular shape. Partition 84 has a concave surface 88 which faces an inner surface of wall 80. A convex surface 90 of partition 84 faces wall 82. A support flange or shelf 92 is joined to and extends horizontally from an upper edge of wall 80. Hook or clip portion 86 includes a horizontal base 94 and a downwardly and inwardly angled leg portion 96. Leg portion 96 terminates in an outwardly angled entrance flange 98. Hook portion 86 defines a channel 100 for receipt of a panel of the article of furniture. It is presently preferred that wire management support 76 be extruded from a flexible plastic material such as rigid PVC 8700. Hook portion 86 may flex to accommodate panels within a thickness range and to securely clamp the support onto the panel.

Figure 3A:
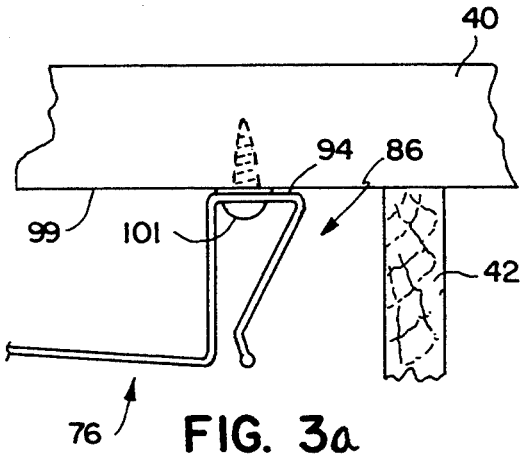
FIG. 3*a* is a fragmentary view showing the support of FIG. 3 attached to the undersurface of a worksurface.

As seen in FIGS. 1 and 2, support 76 may be hooked onto a vertical panel, such as security panel 72. Leg 96 of hook portion 86 clamps against a surface of the security panel to securely retain wire management support 76 thereon. The support cantilevers from panel 72. When supports 76 are hooked over security panels, they extend toward removable panels 24. The supports are hidden from view within the article of furniture. If the supports 76 are hooked over panels 24 or panels 42, 46 so as to extend inwardly under the tops or horizontal surfaces of the articles of furniture, leg 96 of hook portion 86 may be visible depending on the nature of the article, the degree of overhang of the top and the like. In these instances, as shown in FIG. 3*a*, support 76 may be attached to an undersurface 99 of the horizontal worksurface such as top 40 of the article by a suitable fastener. Fastener 101 is a self-tapping screw which passes through horizontal portion 94 of hook portion 86. Support 76 extends adjacent to and inwardly towards a knee space from vertical panel 42.

Partition 84 and wall 80 define a wire management space 102 within which wire or cable 78' may be retained. Flange 92 can serve as a handle for the user to pull wall 80 and base 78 downwardly to allow access to the spaces defined by the support. The support is formed from a resilient material which allows flexing between base 78 and walls 80, 82. The space between convex surface 90 of partition 84 and wall 82 may be used to support and retain an item 104 such as a power strip, power transformer and the like. Items plugged into the power strip may rest on support flange 92. Base 78 assumes a substantially horizontal position when supporting the weight of an article 104.

Figure 5A:
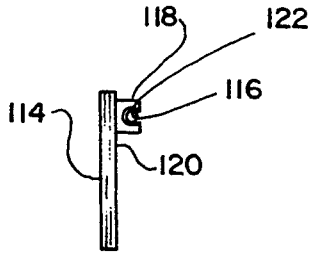
FIG. 5*a* is a side, elevational view of the access cover.
Figure 5:
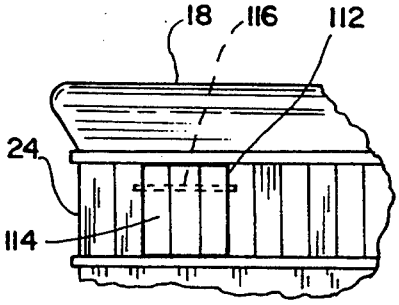
FIG. 5 is a fragmentary, elevational view of a side access cover and opening in a vertical panel of the work station.

Vertical panels 22 of the pedestal and 44 of the credenza, for example, may be provided with wire access openings 112 (FIGS. 1 and 5). Openings 112 may be closed by a moveable cover 114. In the embodiment shown, cover 114 is pivotally mounted on a pivot rod or axle 116 which extends across and is mounted in opposite sides of opening 112. As seen in FIG. 5*a*, a pivot block 118 is secured to a rear surface 120 of cover 114. Pivot block 118 defines a groove 122 dimensioned to snap over and capture pivot rod 116. The user may gain access to the interior space of the article of furniture merely by pivoting cover 114 inwardly or outwardly about pivot rod 116. In addition, cable may be routed upwardly into the space between security panel 72 and rear panel 24 through the base or from underneath the article.

Figure 7:
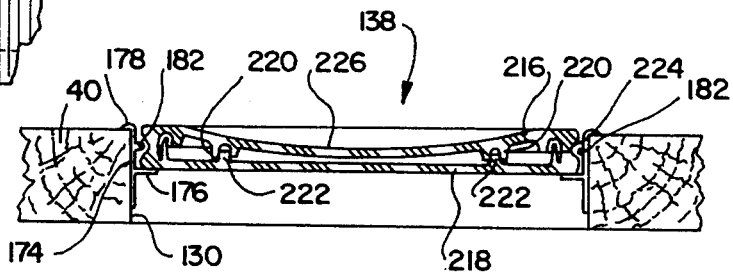
FIG. 7 is a cross-sectional view taken generally along line VII—VII of FIG. 6.

Additional access to the interior of the article of furniture for routing of cords, wires and the like may be provided through top access openings .130 cut into the tops of the furniture. As shown in FIGS. 1 and 7, access opening 130 may be formed in top 40, for example, adjacent to but spaced inwardly from a rear lateral edge of the top surface. In accordance with the present invention, access opening 130 is closed by a closure subassembly generally designated 132. Closure subassembly 132 includes a peripheral sleeve or frame 134 disposed within the access opening and which supports a plurality of access tiles 136, 138.

Figure 8:
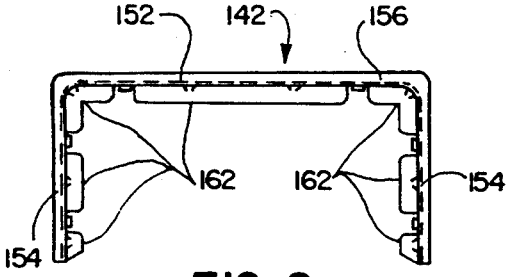
FIG. 8 is a plan view of a sleeve element incorporated in the closure assembly of FIG. 6.
Figure 10:
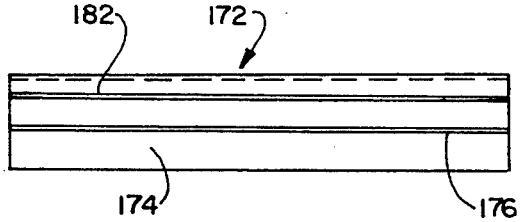
FIG. 10 is a front, elevational view of another sleeve element.
Figure 9:
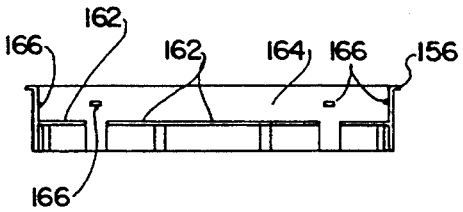
FIG. 9 is a front, elevational view of the sleeve element of FIG. 8.
Figure 11:
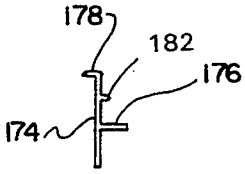
FIG. 11 is an end, elevational view of the element of FIG. 10.
Figure 12:
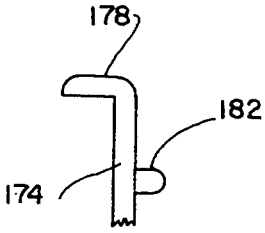
FIG. 12 is a greatly enlarged, fragmentary view of a portion of the element of FIG. 11.

Sleeve 134 includes end portions or sleeve elements 142 pressed into access opening 130 at each end 144, 146 thereof. End portions are positioned within the access opening in opposed, facing relationship. As seen in FIGS. 8 and 9, each sleeve element 142 is generally U-shaped in plan and includes a base 152 joined to legs 154. A retention or border flange or elongated trim bead 156 extends around the periphery of base 152 and legs 154 along an upper edge thereof. Flange 156 extends outwardly and rests on the upper surface of desk top 40. A mounting or slide flange defined by horizontal flange elements 162 extends inwardly from an inner surface 164 of sleeve element 142. A plurality of detents or the retention members 166 also extend inwardly from inner surface 164. Detents 166 are spaced vertically from mounting flange elements 162.

Sleeve 132 also includes elongated elements or extensions 172. As seen in FIGS. 7, 10, 11 and 12, extensions 172 are formed as elongated extrusions and include a vertical web 174, an elongated, horizontally extending mounting flange or slide flange 176 and a retention or border flange 178. As with sleeve portion 142, flange 178 engages and rests on the upper surface of the top of the furniture. Extension 172 also defines an elongated the retention or detent flange 182 which extends outwardly in vertically spaced relationship from mounting flange 176.

It is presently preferred that the sleeve elements be molded or extruded from a plastic material and that the sleeve have a dual durometer construction. The vertical portions of the sleeve and the horizontal mounting flanges are fabricated from a plastic such as rigid PVC 8700. The detent and detent flanges 166, 182 are fabricated from a semi-rigid or resilient plastic such as semi-rigid PVC 7011-EE 80A. Tim detents and detent flanges are softer than the remaining portions of the sleeve. As described below, the detent and detent flanges engage and removably retain the tile elements within the sleeve.

Figure 6:
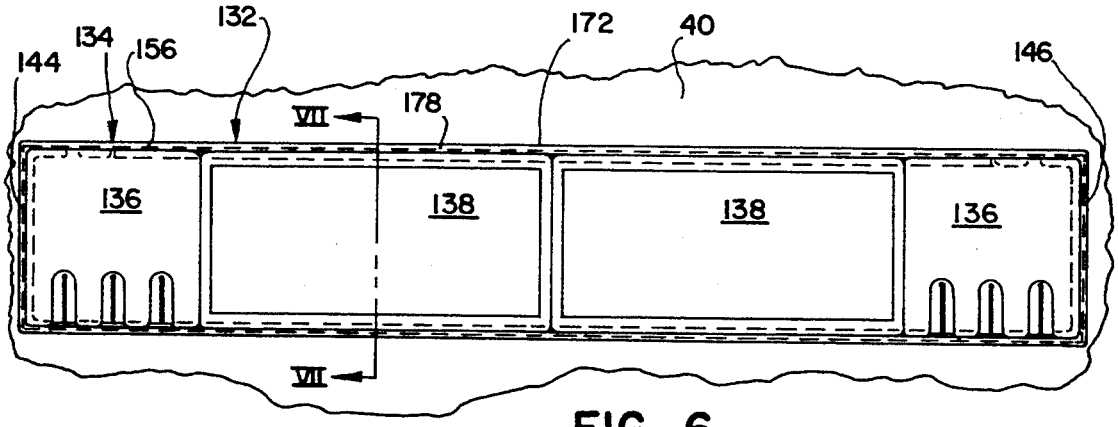
FIG. 6 is a fragmentary, top, plan view of an access opening and closure assembly in accordance with the present invention.

As illustrated in FIG. 6, assembly 132 is provided with four the elements 136, 138. The assembly may be adjusted to include more or less elements or merely a single square element 136. If the single element 136 is used, a pair of the end sleeve elements 142 are positioned in a square access opening in opposed, abutting relationship. As additional tiles are added, the access opening is increased and the portions are moved apart by the extension elements 172. The tiles 136, 138 are easily slid along flanges 162 and 176 of the sleeve. The asseembly, therefore, provides great versatility to the furniture designer and the user.

Figure 13:
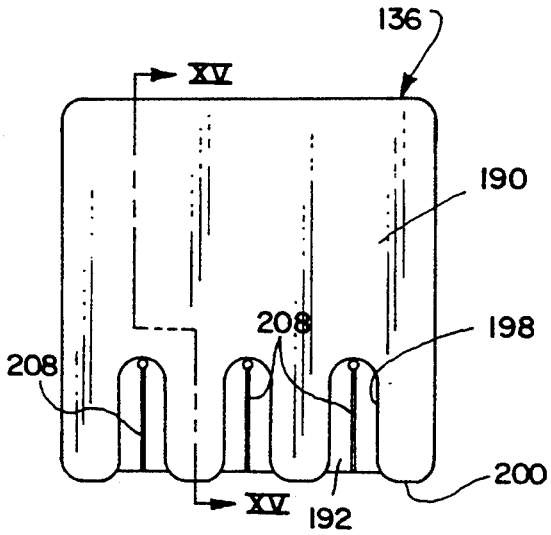
FIG. 13 is a plan view of an access the incorporated in the closure assembly of FIG. 6.
Figure 14:
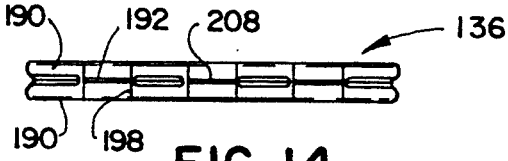
FIG. 14 is an end, elevational view of the tile of FIG. 13.
Figure 15:
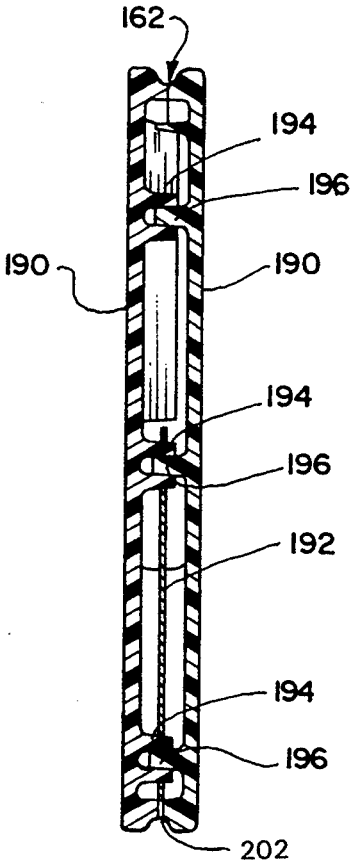
FIG. 15 is a cross-sectional view taken generally along line XV—XV of FIG. 13.
Figure 16:
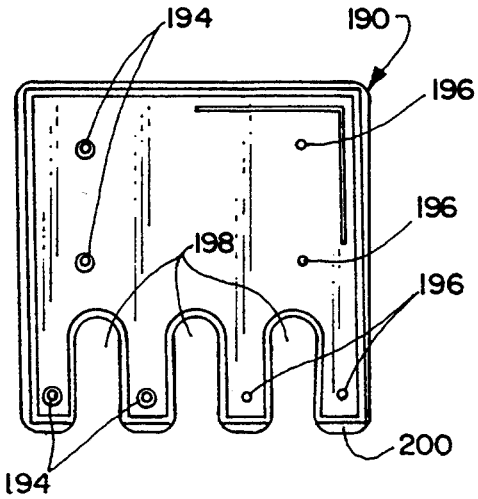
FIG. 16 is a plan view of a the member.
Figure 17:
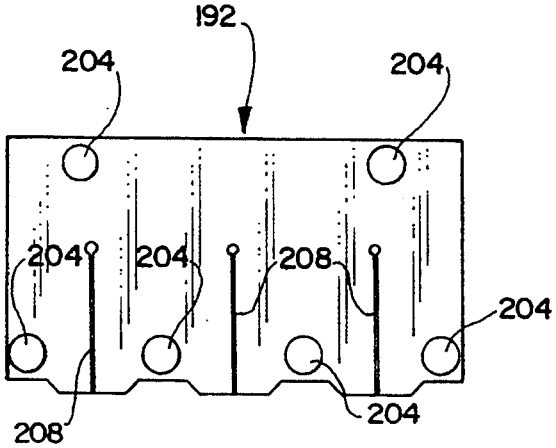
FIG. 17 is a plan view of a light shield incorporated in the tile of FIG. 13.
Figure 18:
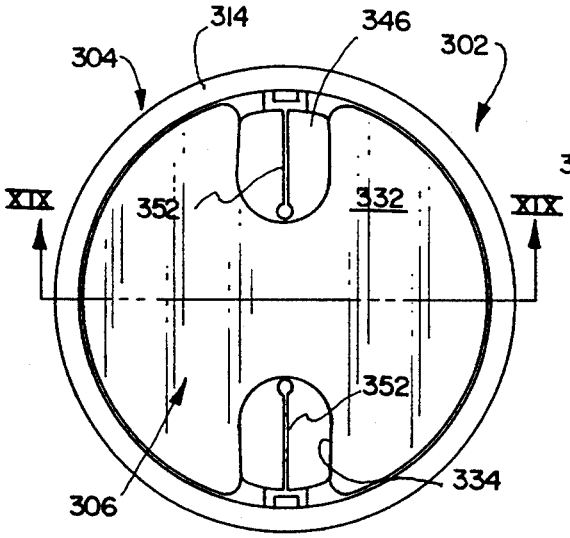
FIG. 18 is top, plan view of an alternative closure assembly in accordance with the present invention.

Access the assembly 136 is best seen in FIGS. 13, 14 and 15. As shown, the assembly 136 includes the halves or elements 190 which sandwich a light shield 192 therebetween. Tile element 190 is a rigid member including bosses 194 and pins 196 on an undersurface thereof (FIG. 16). Tile element 190 further defines a plurality of slots 198 which open through a lateral edge 200 thereof. As seen in FIG. 15, when two of the elements 190 are positioned in opposed relationship, pins 196 of one element fit into bosses 194 of the other element. The elements are secured together by a suitable adhesive. Elements 190 and, hence, tile 136 are configured around peripheral edges thereof to define a peripheral retention or detent groove 202. The groove receives detents 166 or detent flanges 182 of the sleeve assembly elements. Tile 136 is securely yet removably retained within the sleeve.

Light shield 192 is fabricated from a flexible, rubber-like material and is a thin, sheet-like member. Light shield 192 defines apertures 204. Bosses 194 and pins 196, as shown in FIG. 15, pass through apertures 204 of light shield 192 to retain the shield in place. Shield 192 is sandwiched between elements 190. Light shield 192 further defines a plurality of slits 208. Slits 208, as seen in FIG. 13, extend along the centerlines of slots 198 defined by elements 190. Light shield 192 is fabricated from resilient or flexible rubber material such as EPDM having a durometer of 60 plus or minus 5. It is presently preferred that elements 190 be fabricated from a plastic material such as a heavily mineral reinforced PBT blend resin. Such material is a heavy resin which approximates the weight of glass, ceramic, porcelain, ivory and metal and provides the heft and feel of quality. The resin is sold by General Electric Company under the brand name Valox HV700 Series resins. The resin possesses the advantages of engineering thermoplastics and can be injection molded to produce the the elements.

Tile 136, with the slots 198 and slits 208 in the light shield, provide access to opening 130. Cords, wires and the like may be routed into the interior of the article of furniture through the slits and slots.

Tiles 138 have a similar construction to tiles 136. Tiles 138 are filler tiles and do not provide access through the opening. As seen in FIG. 7, tiles 138 include mating halves or elements 216, 218. Elements 216, 218 of tiles 138, in the same manner as elements 190, include bosses 220 and pins 222. The elements are mated at the bosses and pins and glued together. Elements 216, 218 are configured around their peripheral edges to define a retention or detent groove 224. As seen in FIG. 7, detent flange 182 is disposed within the retention groove 224. As shown, the elements 216, 218 are not identical. A surface 226 of element 216 is curved inwardly to define a recess. The filler the functions, therefore, as a pencil holder. The tile elements, therefore, can define or form a desk accessory. Different accessories such as a pencil holder, a cup, a card file clip and the like could be formed on each tile element. The tile could then be rotated to present the desired accessory to the user. In the alternative, of course, elements 216, 218 could be identical as with square tile element 190.

Figure 19:
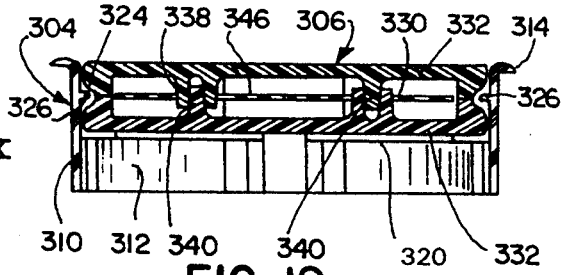
FIG. 19 is a cross-sectional view taken generally along line XIX—XIX of FIG. 18.
Figure 20:
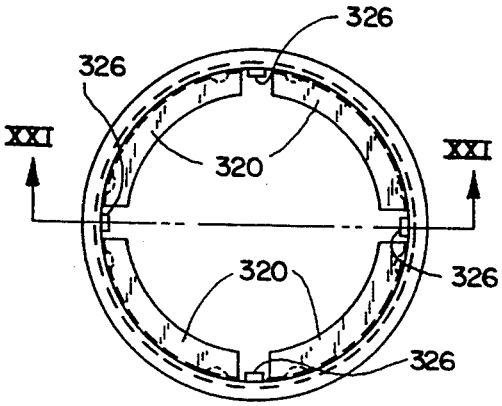
FIG. 20 is a plan view of a sleeve incorporated in the assembly of FIG. 18.
Figure 21:
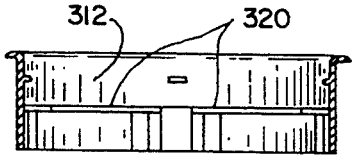
FIG. 21 is a cross-sectional view taken generally along line XXI—XXI of FIG. 20.

An alternative closure assembly 302 is illustrated in FIGS. 18–23. Assembly 302 is adapted for use with circular access openings in a desk or other worksurface. Assembly 302 includes a circular sleeve 304 and a circular the subassembly 306. As seen in FIGS. 19–21, sleeve 304 is cylindrical in shape and includes an outer surface 310 and an inner surface 312. A peripheral border flange 3 14 extends around the upper end of the sleeve. Flange 3 14 retains the sleeve in the access opening and performs a decorative function. A mounting flange, including a plurality of flange portions 320, extends inwardly from inner surface 312 of sleeve 304. As seen in FIG. 19, flange portions 320 support the 306. Tile 306 defines a peripheral groove 324. Sleeve 304 defines detents 326 on inner surface 312 which are disposed in groove 324. As with the prior embodiments, detents 326 engage and retain tile 306 within the sleeve.

Figure 23:
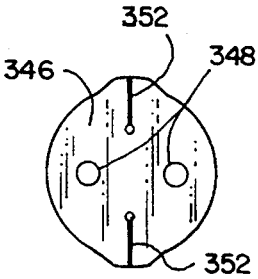
FIG. 23 is a plan view of a light shield incorporated in the closure assembly of FIG. 18.
Figure 22:
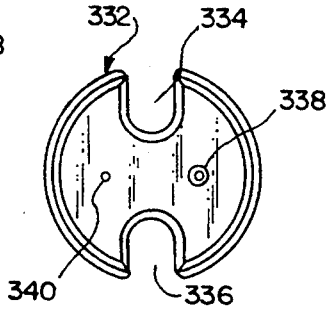
FIG. 22 is a bottom view of a the member incorporated in the embodiment of FIG. 18.

Tile 306 is of a construction similar to the 136. The tile includes mating tile halves or elements 332 (FIG. 22). Each the element 332 defines slots 334,336, bosses 338 and attachment pins 340. A pair of halves 332 are assembled as shown in FIG. 19 with pins 340 received in bosses 338. Halves 332 sandwich a light shield 346 (FIG. 23). Shield 346 defines apertures 348 through which bosses 338 and pins 340 extend. The halves are glued together. Light shield 346 defines opposed slits 352. Slits 352 permit cords to pass through slots 334 of the 306.

Figure 24:
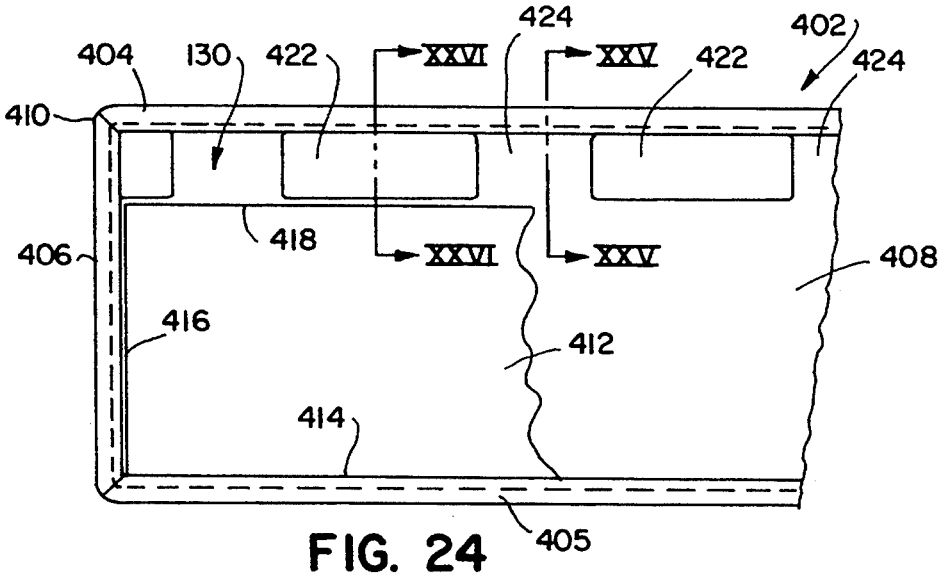
FIG. 24 is a fragmentary, plan view of a desk or credenza top for use with the closure assembly in accordance with the present invention.
Figure 25:
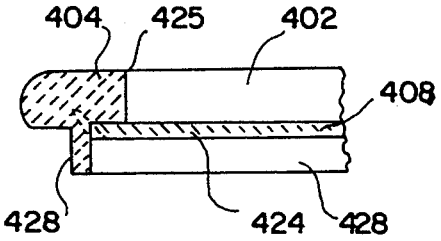
FIG. 25 is a fragmentary cross-sectional view taken generally along line XXV—XXV of FIG. 24.
Figure 26:
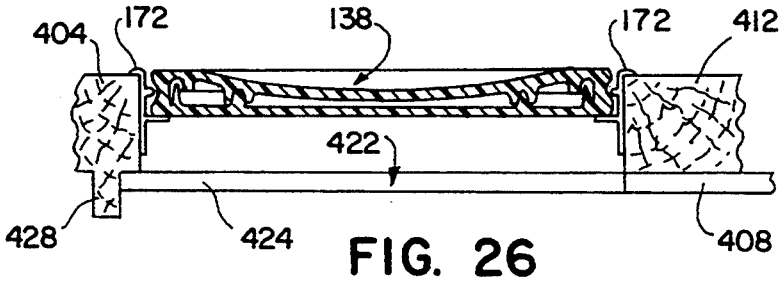
FIG. 26 is a fragmentary cross-sectional view taken generally along line XXVI—XXVI of FIG. 24.

A top construction for a desk, credenza and the like and which defines access opening 130 is illustrated in FIGS. 24–26 and generally designated by the numeral 402. When the access opening 130 is positioned immediately adjacent a rear edge of the top, reinforcement may be necessary for the desk structure. The portion of the desk in a wood desk between the access opening and the outer lateral edge of the desk should be stabilized. Top 402 is of a multi-piece construction which may be covered with a suitable veneer to provide a desired wood furniture finish. As shown, top 402 includes a plurality of edge trim pieces or nose pieces 404, 405,406. The pieces are secured to the perimeter of a planar base sheet or board 408 and joined together at miter joints 410. The nose pieces, in effect, frame piece 408. An insert 412 is secured to base piece 408. Insert 412 is glued or mechanically fastened to board 408. Insert 412 includes a lateral edge 414 which abuts against a front nose piece 405 and lateral edges 416 which abut against end nose pieces 406. The insert extends between pieces 406 along the length of piece 405. Another lateral edge 418 is spaced from rear nose piece 404. The spacing between lateral edge 418 and nose piece 408 defines access slot 130.

Board 408 is formed with a series of spaced, tandemly arranged access slots 422. The board, therefore, also defines a plurality of finger or reinforcement sections 424 between slots 422. Nose piece 404 is secured to board 408 by suitable fasteners such as staples 425 driven through the outer lateral edges of the portions 424. As seen in FIGS. 25 and 26, pieces 404, 405 and 406 each include a depending skirt 428 against which finger portion 424 abuts. The nose pieces define a shoulder which rests on an upper surface of fingers 424 and the peripheral perimeter portions of board 408. Piece 404 is, therefore, securely attached to the remainder of the desk top and stabilized. Movement or bowing of piece 404 outwardly with respect to the access opening is prevented.

In a wood desk construction, insert 412 and planar piece 408 may be fabricated from particle board. The nose pieces are formed from solid wood and define perimeter trim molding for the desk. The insert may be covered with a suitable veneer for aesthetic purposes.

In top constructions made of solid wood, tops with the opening spaced inwardly sufficiently from a lateral edge or when access openings having limited lengths to accommodate a single tile are desired, the opening would be cut directly through the top piece. In addition, stabilizing portions or attachments between the outer peripheral edges and the remaining portion of the desk top could be readily formed during the routing operation, for example. A single piece top having the shape of that of FIGS. 24–26 could be fabricated with conventional techniques.

As seen in FIG. 26, a space is defined between the tile pieces 138 and finger portions 424 of base board 408. Cords and the like may be routed over and supported by the finger portions. Access to the space below the top is provided through slots 422.

The components of the wire management system in accordance with the present invention provide for efficient control and management of all wires, cables, cords and the like associated with a typical work station. In addition, power strips, transformers and other items may be supported on the wire management supports or clips which are cantilevered from the panels or readily secured to the underside of horizontal worksurfaces of the furniture. Ready access to the interior is provided by access openings in the furniture. Versatility in the configuration and dimensions of the access openings and top surfaces is provided by the closure assemblies in accordance with the present invention. The subject components are relatively easily manufactured applying conventional manufacturing techniques. The components are readily added to existing furniture or incorporated in new designs and configurations. The system is adaptable to interconnection of multiple pieces of furniture, as shown, for example, in FIG. 1. The system is reliable and versatile in use.

In view of the above description, those of ordinary skill in the art may envision various modifications which would not depart from the inventive concepts disclosed herein. It is expressly intended, therefore, that the above should be considered as only a description of the preferred embodiments. The true spirit and scope of the present invention may be determined by reference to the appended claims.

The embodiments of the invention in which an exclusive property or privilege is claimed are defined as follows:

1. An article of furniture, comprising:

an elongated horizontal top;

a support operatively connected to said top, said support having a vertical panel;

a plurality of wire management clips including a hook portion and a base at least one of said clips having said hook portion clamped onto the vertical panel such that the base is cantilevered outwardly from the vertical panel, said clips being positioned in spaced relationship under said horizontal top; and access means on at least one of said top and said panel for providing access to the space behind said panel and below said top for routing wires through said article with the wires being supported on said wire management clips.

2. An article of furniture as defined by claim 1 further including an end panel joined to said vertical panel and wherein said vertical panel is a security panel extending from said end panel in spaced relationship to a rear edge thereof and wherein said article further includes a rear panel and mounting means for removably mounting said rear panel to said article in abutting relationship to said end panel and in spaced relationship to said security panel.

3. An article of furniture as defined by claim 1 wherein one of said wire management clips is secured to an undersurface of said top.

4. An article of furniture as defined by claim 1 wherein said wire management clip further comprises:

a partition joined to said base in spaced relationship to said hook portion; and an outer wall joined to said base in spaced relationship to said partition.

5. An article of furniture as defined by claim 4 wherein said partition is curved in cross section so as to resiliently engage articles of varying widths between said partition and said hook portion.

6. An article of furniture comprising:

an elongated horizontal top;

a support operatively connected to said top, said support having a vertical panel a plurality of wire management clips including a hook portion and a base, said clips being positioned in spaced relationship under said horizontal top;

access means on at least one of said top and said panel for providing access to the space behind said panel and below said top for routing wires through said article with the wires being supported on said wire management clips; and said wire management clip further comprising a partition joined to said base in spaced relationship to said hook portion, and an outer wall joined to said base in spaced relationship to said partition, said partition being curved in cross section so as to resiliently engage articles of varying widths between said partition and said hook portion, and said outer wall having a generally inverted L-shape in cross section including a vertical leg joined to said base and a horizontal leg joined to said vertical leg, said horizontal leg defining a support shelf.

7. An article of furniture as defined by claim 6 wherein said hook portion of said clip includes a vertical sidewall joined to said base, a horizontal portion and a downwardly and inwardly directed outer portion resiliently joined to said horizontal portion, said hook portion snapping over said vertical panel to support said clip under said top on said vertical panel.

8. An article of furniture as defined by claim 7 further including an end panel joined to said vertical panel and wherein said vertical panel is a security panel extending from said end panel in spaced relationship to a rear edge thereof and wherein said article further includes a rear panel and mounting means for removably mounting said rear panel to said article in adjacent relationship to said end panel and in spaced relationship to said security panel.

9. An article of furniture as defined by claim 8 further including a modesty panel positioned below said top and wherein at least one of said wire management clips is secured to an undersurface of said top adjacent said modesty panel by a fastener extending through said horizontal portion of said clip.

10. An article of furniture as defined by claim 1 wherein one of said top and said panel defines an access opening and said access means comprises:

a cover; and mounting means engaging said cover for moveably mounting the cover at said access opening.

11. An article of furniture comprising:

an elongated horizontal top;

a support operatively connected to said top, said support having a vertical panel;

a plurality of wire management clips including a hook portion and a base, said clips being positioned in spaced relationship under said horizontal top;

access means on at least one of said top and said panel for providing access to the space behind said panel and below said top for routing wires through said article with the wires being supported on said wire management clips;

one of said stop and said panel defining an access opening, said access means comprising a cover and mounting means engaging said cover for movably mounting the cover at said access opening; and said mounting means comprising a pivot rod extending across said access opening, and a pivot block joined to a rear surface of said cover, said block defining a groove dimensioned to snap onto and capture said pivot rod.

12. An article of furniture comprising:

an elongated horizontal top;

a support operatively connected to said top, said support having a vertical panel;

a plurality of wire management clips including a hook portion and a base, said clips being positioned in spaced relationship under said horizontal top;

access means on at least one of said top and said panel for providing access to the space behind said panel and below said top for routing wires through said article with the wires being supported on said wire management clips;

one of said top and said panel defines an access opening, said access means comprising a cover, and mounting means engaging said cover for movably mounting the cover at said access opening; and said wire management clip further comprising a partition joined to said base in spaced relationship to said hook portion, and an outer wall joined to said base in spaced relationship to said partition.

13. An article of furniture as defined by claim 12 wherein said partition is curved in cross section and defines a concave surface facing said outer wall.

14. An article of furniture as defined by claim 13 wherein said outer wall has a generally inverted L-shape in cross section including a vertical leg joined to said base and a horizontal leg joined to said vertical leg, said horizontal leg defining a shelf.

15. An article of furniture as defined by claim 14 wherein said hook portion of said clip includes a vertical sidewall joined to said base, a horizontal portion joined to said sidewall and a downwardly and inwardly directed outer portion resiliently joined to said horizontal portion, said hook configured to snap over panels of varying thickness.

16. An article of furniture as defined by claim 15 further including an end panel joined to said vertical panel and supporting said top and wherein said vertical panel is a security panel extending from said end panel in spaced relationship to a rear edge thereof and wherein said article further includes a rear panel and mounting means for removably mounting said rear panel to said article in adjacent relationship to said end panel and in spaced relationship to said security panel.

17. An article of furniture as defined by claim 1 wherein said top defines an access opening and wherein said access means comprises: a support frame disposed within said access opening of said top, said frame including a support flange extending therefrom; and a tile removably positioned on said support flange to close said access opening.

18. An article of furniture, comprising:

an elongated horizontal top;

a support operatively connected to said top, said support having a vertical panel;

a plurality of wire management clips including a hook portion and a base, said clips being positioned in spaced relationship under said horizontal top;

access means on at least one of said top and said panel for providing access to the space behind said panel and below said top for routing wires through said article with the wires being supported on said wire management clips;

said top defining an access opening, said access means comprising a support frame disposed within said access opening of said top, said frame including a support flange extending therefrom, and a the removably positioned on said support flange to close said access opening; and said support frame further defining a detent resiliently engaging said tile.

19. An article of furniture as defined by claim 18 wherein said the includes upper and lower elements joined together to define said tile.

20. An article of furniture as defined by claim 19 wherein said upper element defines a desk accessory.

21. An article of furniture as defined by claim 19 further including a light shield sandwiched between said upper and lower elements, said elements defining at least one slot and said light shield defining a slit within said slot so that a cord can pass through said tile at said slot.

22. An article of furniture as defined by claim 21 wherein said elements are rectangular in plan.

23. An article of furniture as defined by claim 21 wherein said elements are generally circular in plan.

24. An article of furniture as defined by claim 22 wherein said support frame comprises a generally U-shaped end piece and elongated side members positioned in said access opening in adjacent relationship with said end piece.

25. An article of furniture as defined by claim 24 wherein said end piece and said side members include a plurality of detents.

26. An article of furniture as defined by claim 25 wherein said detents are formed from a material having a different durometer than the remaining portions of said support frame.

27. An article of furniture as defined by claim 23 wherein said support frame comprises:

a generally cylindrical member having inner and outer surfaces;

a border flange extending outwardly from an upper end of said cylindrical member; and a tile support flange extending inwardly from the inner surface of said cylindrical member.

28. An article of furniture as defined by claim 27 further including a plurality of detents on said inner surface, said detents being vertically spaced from said tile support flange.

29. An article of furniture as defined by claim 28 wherein said detents are formed from a material having a different durometer than the remaining portions of said support frame.

30. An article of furniture as defined by claim 29 wherein said horizontal top defines an elongated access opening extending adjacent to a lateral edge thereof.

31. An article of furniture as defined by claim 30 wherein said top includes a plurality of reinforcement and stabilizing fingers extending from and interconnecting one lateral edge of said access opening to another lateral edge thereof.

32. An article of furniture as defined by claim 30 wherein said top comprises:

a planar base member;

a frame extending around and joined to the periphery of said base member; and an insert on said base member, said insert having a lateral edge spaced from said frame to define said elongated access opening.

33. An article of furniture as defined by claim 32 wherein said planar base member defines a plurality of tandemly arranged slots opening therethrough within said access opening to allow access to the underside of said top, said slots being separated by fingers which are joined to said frame.

34. An article of furniture as defined by claim 33 wherein said vertical panel of said support defines another access opening and said article of furniture further includes a cover and pivot means engaging said cover for pivotally mounting the cover to said vertical panel at said access opening.

35. A work station, comprising:

a top;

a pedestal supporting said top, said pedestal including spaced side panels, a rear panel, means for removably mounting said rear panel on said pedestal and a security panel extending between said side panels and dimensioned to prevent access to a drawer supported by said pedestal when the rear panel is removed;

a modesty panel extending below said top from said pedestal; and a plurality of wire management supports mounted in spaced relationship along said security panel and said modesty panel, each of said supports including a base, a pair of spaced sidewalls joined to said base, a partition wall joined to said base intermediate said sidewalls and attachment means joined to one of said sidewalls for hooking said support on at least one of said panels so as to cantilever outwardly therefrom.

36. A work station as defined by claim 35 wherein at least one of said side panels of said pedestal defines an access opening adjacent said security panel for routing a wire into the space between the rear and security panels for support by said wire management supports.

37. A work station as defined by claim 36 wherein said wire management support further includes a support flange extending generally horizontally from the other of said sidewalls.

38. A work station as defined by claim 37 wherein said partition is curved in cross section.

39. A work station as defined by claim 38 wherein said attachment means comprises a hook portion having a base portion joined to said one of said sidewalls and a leg portion extending from said base portion downwardly and inwardly towards said one of said sidewalls and wherein said work station further includes a plurality of fasteners extending through the base portions of some of said wire management supports for securing such supports to an undersurface of said top adjacent one of said panels.

40. A work station as defined by claim 39 further comprising:

a cover; and pivot means connected to said cover for pivotally mounting the cover at said access opening.

41. A work station as defined by claim 39 wherein said top defines an access opening therethrough.

42. A work station as defined by claim 41 further including removable closure means on said top for closing said access opening in said top.

43. A work station as defined by claim 42 wherein said removable closure means comprises:

a sleeve having an inner surface defining a mounting flange, said sleeve dimensioned to be disposed within said access opening in said top; and a tile resting on said mounting flange.

44. A work station as defined by claim 43 further comprising a detent on said inner surface of said sleeve for resiliently engaging said tile and retaining said tile within said sleeve.

45. A work station as defined by claim 44 wherein said sleeve includes a generally U-shaped portion having a base and spaced legs.

46. A work station as defined by claim 44 wherein said the comprises:

a member defining a slot; and a resilient shield joined to said member at a slot and defining a slit for passage of a wire through said tile.

47. A work station as defined by claim 46 wherein said removable closure means further comprises another tile disposed on said mounting flange in tandem with said tile.

48. A work station as defined by claim 47 wherein said sleeve includes another U-shaped portion and a pair of elongated portions extending between the legs of said U-shaped portions.

49. A work station as defined by claim 44 wherein said sleeve is generally cylindrical in shape and said tile includes first and second rigid portions defining a slot and a flexible light shield sandwiched between said rigid portions and defining a slit aligned with said slot.

50. A wire management support adapted to be attached to a panel of an article of furniture, said support comprising:

a base;

a front wall joined to said base;

a rear wall joined to said base;

a partition joined to said base intermediate said walls; and a hook joined to said rear wall, said hook being formed from a resilient material so that it will clamp onto panels of different thickness and whereby the support will cantilever outwardly from the panel.

51. A wire management support as defined by claim 50 further comprising a support shelf joined to and extending outwardly from an upper edge of said front wall.

52. A wire management support as defined by claim 50 wherein said hook includes an out-turned entrance flange.

53. A wire management support as defined by claim 51 wherein said partition is curved in cross section to define a wire retention space with said front wall.

54. A wire management support as defined by claim 53 wherein said base is joined to said rear wall and angles upwardly therefrom so that the base will move towards horizontal when an object is placed between the partition and the rear wall.

55. A closure assembly for an access opening in the surface of an article of furniture, said closure assembly comprising:

a sleeve dimensioned to be received within the access opening, said sleeve defining a peripheral retention flange, a mounting flange along an interior surface of said sleeve and at least one detent on the inner surface spaced from said retention flange; and at least one the disposed on said mounting flange and removably retained within said sleeve by engagement with said detent.

56. A closure assembly as defined by claim 55 wherein said tile defines a peripheral groove dimensioned to receive said detent.

57. A closure assembly as defined by claim 56 wherein said tile comprises first and second halves joined together to define said peripheral groove.

58. A closure assembly as defined by claim 57 wherein said halves define a slot for the passage of a wire.

59. A closure assembly as defined by claim 58 further including a flexible light shield sandwiched between said halves and defining a slit extending along said slot.

60. A closure assembly as defined by claim 55 wherein said sleeve is rectangular and said assembly includes a plurality of tiles.

61. A closure assembly as defined by claim 60 wherein some of said tiles define slots for passage of wire therethrough.

62. A closure assembly as defined by claim 59 wherein said sleeve and said tile are generally circular in plan.

63. A closure assembly for an access opening in the horizontal worksurface of an article of furniture, said assembly comprising:

a sleeve having a pair of end pieces adapted to be positioned within the access opening in opposed relationship, said end pieces each defining a generally horizontally extending mounting flange; and a the dimensioned to fit within the access opening, said the being supported on said mounting flange.

64. A closure assembly as defined by claim 63 wherein said end pieces are generally U-shaped in plan, each having a base and spaced legs.

65. A closure assembly as defined by claim 64 further comprising:

at least a pair of elongated sleeve members, said elongated sleeve members extending between opposed legs of said end pieces.

66. A closure assembly as defined by claim 65 wherein said end pieces each define an elongated trim bead and a detent.

67. A closure assembly as defined by claim 63 further including a plurality of additional tiles, said tiles being slidable along said mounting flanges of said end pieces and said sleeve members.

68. A wire management support adapted to be attached to a panel of an article of furniture, said support comprising:

a base;

a front wall joined to said base;

a rear wall joined to said base;

a partition joined to said base intermediate said walls; and a clip joined to said rear wall, said clip being configured to resiliently clamp onto panels of different thickness such that the support will cantilever outwardly from the panel.

69. A wire management system comprising a plurality of the wire management supports defined in claim 50.

* * * * *

UNITED STATES PATENT AND TRADEMARK OFFICE

CERTIFICATE OF CORRECTION

PATENT NO. : 5,451,101
DATED : September 19, 1995
INVENTOR(S) : Samuel J. Ellison; John VanKammen; Daniel Grabowski; and Bruce Finlayson It is certified that error appears in the above-indentified patent and that said Letters Patent is hereby corrected as shown below:

Column 1, line 8;
"tile" should be –the–.

Column 1, line 16;
"tile" should be –the–.

Column 1, line 50;
"all" should be –an–.

Column 1, line 67;
"the" (first and third occurrences) should be –tile–.

Column 2, line 45;
"the" should be –tile–.

Column 2, line 51;
"the" should be –tile–.

Column 2, line 62;
"the" should be –tile–.

Column 3, line 30;
"2,853,251" should be –2,853,351–.

UNITED STATES PATENT AND TRADEMARK OFFICE

CERTIFICATE OF CORRECTION

PATENT NO. : 5,451,101
DATED : September 19, 1995
INVENTOR(S) : Samuel J. Ellison; John VanKammen; Daniel Grabowski; and Bruce Finlayson It is certified that error appears in the above-indentified patent and that said Letters Patent is hereby corrected as shown below:

Column 3, line 49;
"for" should be –far–.

Column 4, line 65;
"openings .130" should be –opening 130–.

Column 5, line 19;
"the" should be –tile–.

Column 5, line 31;
"the" should be –tile–.

Column 5, line 41;
"Tim" should be –The–.

Column 5, line 47;
"the" should be –tile–.

Column 5, line 56;
" asseembly" should be –Assembly–.

Column 5, line 58;
"the" should be –tile–.

Column 5, line 59;
"the" (both occurrences) should be –tile–.

UNITED STATES PATENT AND TRADEMARK OFFICE

CERTIFICATE OF CORRECTION

PATENT NO. : 5,451,101
DATED : September 19, 1995
INVENTOR(S) : Samuel J. Ellison; John VanKammen; Daniel Grabowski; and Bruce Finlayson It is certified that error appears in the above-indentified patent and that said Letters Patent is hereby corrected as shown below:

Column 6, line 26;
"the" (second occurrence) should be --tile--.

Column 6, line 42;
"the" should be --tile--.

Column 6, line 44;
"the" (second occurrence) should be --tile--.

Column 6, line 56;
"the" should be --tile--.

Column 6, line 64;
"the" should be --tile--.

Column 7, line 1;
"the" (first occurrence) should be --tile--.

Column 7, line 3;
"the" should be --tile--.

Column 7, line 11;
"the 306." should be --tile 306.--.

Column 11, claim 18, line 9;
"the" should be --tile--.

UNITED STATES PATENT AND TRADEMARK OFFICE

CERTIFICATE OF CORRECTION

PATENT NO. : 5,451,101
DATED : September 19, 1995
INVENTOR(S) : Samuel J. Ellison; John VanKammen; Daniel Grabowski; and Bruce Finlayson It is certified that error appears in the above-indentified patent and that said Letters Patent is hereby corrected as shown below:

Column 11, claim 19, line 15;
"the" should be –tile–.

Column 13, claim 46, line 15;
"the" should be –tile–.

Column 14, claim 55, line 3;
"the" should be –tile–.

Column 14, claim 63, line 34;
"the" (first occurrence) should be –tile–.

Column 14, claim 63, line 36;
"the" should be –tile–.

Signed and Sealed this

Sixteenth Day of April, 1996

Bruce Lehman

*Attest:*

BRUCE LEHMAN

*Attesting Officer*

*Commissioner of Patents and Trademarks*